US008094172B2

(12) United States Patent
Endo

(10) Patent No.: US 8,094,172 B2
(45) Date of Patent: Jan. 10, 2012

(54) IMAGE DISPLAY DEVICE AND LIQUID CRYSTAL TELEVISION HAVING DISTRIBUTED SUBFRAME IMAGE DATA TO A PLURALITY OF PIXELS

(75) Inventor: Joichi Endo, Osaka (JP)

(73) Assignee: Funai Electric Co., Ltd., Daito-shi,Osaka (JP)

( * ) Notice: Subject to any disclaimer, the term of this patent is extended or adjusted under 35 U.S.C. 154(b) by 817 days.

(21) Appl. No.: 12/154,710

(22) Filed: May 27, 2008

(65) Prior Publication Data

US 2008/0297455 A1 Dec. 4, 2008

(30) Foreign Application Priority Data

May 28, 2007 (JP) ..... 2007-140612

(51) Int. Cl.
*G09G 5/02* (2006.01)

(52) U.S. Cl. ..... 345/698; 345/89

(58) Field of Classification Search ..... 345/689–699, 345/87–89

See application file for complete search history.

(56) References Cited

U.S. PATENT DOCUMENTS

2002/0196220 A1 12/2002 Sato et al.
2003/0048285 A1* 3/2003 Okuzawa et al. ..... 345/690
2003/0133060 A1 7/2003 Shimada
2004/0051470 A1* 3/2004 Hashimoto et al. ..... 315/169.3
2005/0225570 A1 10/2005 Collins
2007/0200810 A1* 8/2007 Kawata ..... 345/89

FOREIGN PATENT DOCUMENTS

JP 2002-335471 A 11/2002
JP 2004-294973 A 10/2004
JP 2005-208413 A 8/2005

OTHER PUBLICATIONS

The extended European search report, pursuant to Rule 62 EPC dated Sep. 23, 2008, searched on Sep. 1, 2008.

* cited by examiner

*Primary Examiner* — Chanh Nguyen
*Assistant Examiner* — Long Pham
(74) *Attorney, Agent, or Firm* — Yokoi & Co., U.S.A., Inc.; Toshiyuki Yokoi

(57) ABSTRACT

There is provided an image display device in which a display panel is driven based a plurality of sub-frame image data produced from a frame image data representing an image of one screen to display the image, the image display device includes: a dividing unit to divide the frame image data into a plurality of sub-frame image data; and a panel drive controlling unit to make each pixel data of one sub-frame image data correspond to each pixel of the display panel by one-to-one and to drive each pixel of the display panel, and to distribute each pixel data of other sub-frame image data to a plurality of pixels of the display panel that are adjacent in the display panel in a predetermined ratio and to drive each pixel of the display panel.

5 Claims, 14 Drawing Sheets

IMAGE DISPLAY DEVICE AND LIQUID CRYSTAL TELEVISION HAVING DISTRIBUTED SUBFRAME IMAGE DATA TO A PLURALITY OF PIXELS

CROSS-REFERENCES TO RELATED APPLICATIONS

The present application is related to the Japanese Patent Application No. 2007-140612, filed May 28, 2007, the entire disclosure of which is expressly incorporated by reference herein.

BACKGROUND OF THE INVENTION

1. Field of the Invention

The present invention relates to an image display device and a liquid crystal television.

2. Description of Related Art

In recent years, images have been further improved in quality and definition. There has been an television in which images are displayed based on image data conforming to a HiVision television format such as, for example, full high definition (HD).

JP2002-335471A discloses a projection image display device in which data of a plurality of sub-frame images is generated from data of each frame image forming an image and the plurality of sub-frame images is displayed by a time division manner on a display panel.

JP2005-208413A discloses an image processing apparatus in which the output image of one frame is divided into a plurality of sub-frames and subjected to a resolution conversion process in a time divisional fashion in units of sub frame using the linear interpolation method.

JP2004-294973A discloses a technique in which a redundancy pixel embedding unit embeds dummy data in an image data read from a frame memory to provide it for a display panel as an image output signal, thereby enabling sharing a data driver with display panels different in resolution from each other.

In order to realize a high picture-quality display using image data with a large number of pixels such as the above HiVision, it is fundamentally required to use a high quality model with a large number of pixels as a display panel for displaying images. However, such a display panel has a problem in that a production cost is also expensive.

On the other hand, when display is performed based on the image data with a large number of pixels using a display panel with a small number of pixels and an inexpensive production cost, the number of pixels in the image data needs to be matched and converted (or reduced) to the number of pixels of the display panel using a resolution conversion means called a scaler. However, such a resolution conversion degrades image quality, causing a problem in that an accurate expression of an original image data cannot be realized.

If the image data with a large number of pixels can be displayed using a low-resolution display panel inexpensive in a production cost with the image quality maintained, the above problems can be solved. However, none of the above applications enables maintaining image quality when image data with a number of pixels is displayed by a display panel the pixels of which are fewer than those of the image data.

BRIEF SUMMARY OF THE INVENTION

The present invention discloses an image display device and a liquid crystal television capable of realizing the display of high quality image with a lower cost.

One aspect of the present invention provides an image display device in which a display panel is driven based a plurality of sub-frame image data produced from a frame image data representing an image of one screen to display the image, including: a dividing unit to divide the frame image data into a plurality of sub-frame image data; and a panel drive controlling unit to make each pixel data of one sub-frame image data correspond to each pixel of the display panel by one-to-one and to drive each pixel of the display panel, and to distribute each pixel data of other sub-frame image data to a plurality of pixels of the display panel that are adjacent in the display panel in a predetermined ratio and to drive each pixel of the display panel.

Each pixel data is distributed to a plurality of pixels adjacent in the display panel in a predetermined ratio at the period when display is performed based on the other sub-frame image data, so that a viewer (user) views as if the centroid of luminance was positioned also between pixels of the display panel (the pixel of the display panel is referred to as real pixel), as a result, the user visually recognizes a virtual pixel between the real pixels. That is to say, according to the present invention, a virtual pixel as well as the real pixel of the display panel is visually recognized between the real pixels. For this reason, when image data with a number of pixels is displayed on a display panel the pixels of which are fewer in number than the pixels of the image data, the frame image is divided into a plurality of sub frames and displayed as described above, enabling displaying images whose picture quality is maintained without reducing the number of pixels of the original image data.

As one example of a concrete configuration, the dividing unit divides the frame image data into a first sub-frame image data composed of each pixel data in the odd column and a second sub-frame image data composed of each pixel data in the even column, and the panel drive controlling unit makes each pixel data of the first sub-frame image data correspond to each pixel of the display panel by one-to-one and distributes each pixel data of the second sub-frame image data substantially equally to two pixels that are adjacent in the row direction in the display panel. According to the above configuration, even a display panel the number of real pixels of which is only a half of the number of pixels of the image data can display an image based on the image data without reducing the number of pixels of the image data.

As another example of a concrete configuration, the dividing unit divides the frame image data into a first sub-frame image data composed of each pixel data in each left column in each region composed of three adjacent columns, a second sub-frame image data composed of each pixel data in each central column in each the region (region mentioned above) and a third sub-frame image data composed of each pixel data in each right column in each the region, and the panel drive controlling unit makes each pixel data of the first sub-frame image data correspond to each pixel of the display panel by one-to-one, and distributes each pixel data of the second sub-frame image data in a higher ratio to left pixel than to right pixel of two pixels that are adjacent in the row direction in the display panel, and distributes each pixel data of the third sub-frame image data in a higher ratio to the right pixel than to the left pixel of two pixels that are adjacent in the row direction in the display panel. According to the above configuration, even a display panel the number of real pixels of which is only one third the number of pixels of the image data can display an image based on the image data without reducing the number of pixels of the image data.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. For example, such variations and alternate embodiments are contemplated, and can be made without departing from the spirit and scope of the invention.

An embodiments of the present invention are described below in the following order.

1. Schematic configuration of television set
2. First embodiment
3. Second embodiment
4. Conclusion

1. Schematic Configuration of Television Set

Figure 1:
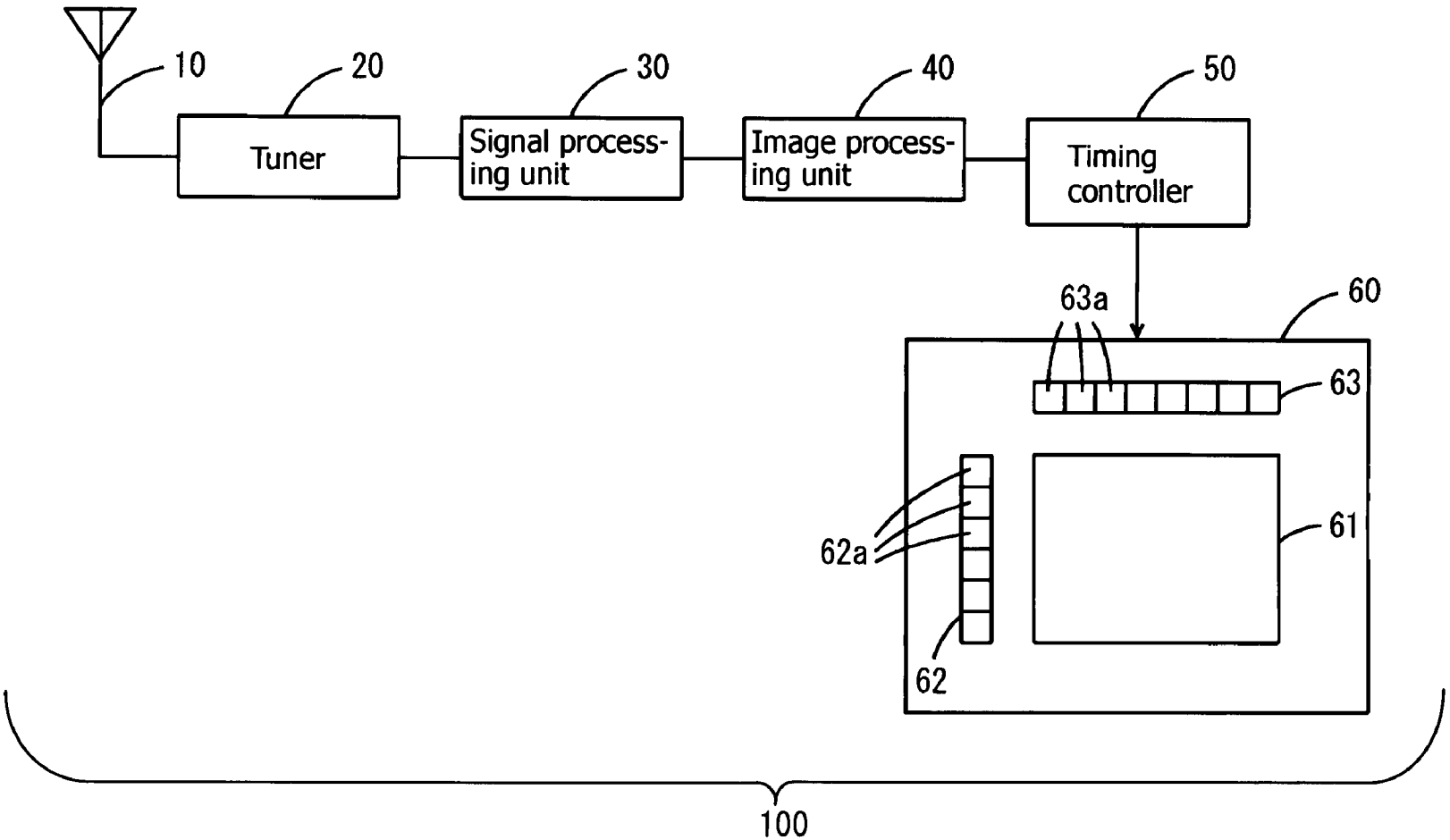
FIG. 1 is a block diagram illustrating one example of a schematic configuration of a television set.

FIG. 1 is a block diagram illustrating a schematic configuration of a television set.

The figure illustrates an antenna 10, a tuner unit 20, a signal processing unit 30, an image processing unit 40, a timing controller (TC) 50 and a liquid crystal module 60 as part of the configuration of a television set (hereinafter, referred to as "TV") 100. In this sense, the TV 100 is a liquid crystal TV. It is needless to say that the TV 100 may use other kinds of display devices such as a plasma display panel (PDP), a CRT or the like.

The liquid crystal module 60 includes a liquid crystal panel (display panel) 61 with a predetermined number of pixels (real pixels), a gate driver 62 for driving each scanning line of the liquid crystal panel 61 and a source driver 63 for driving each signal line of the liquid crystal panel 61. The gate driver 62 is formed of a plurality of gate drivers IC 62*a*. The source driver 63 is formed of a plurality of source drivers IC 63*a*. Scanning lines corresponding to the predetermined number of pixels (for example, several hundred pixels) in the vertical direction (or in the column direction) extend from each gate driver IC 62*a*. Signals lines corresponding to the predetermined number of pixels in the horizontal direction (or in the row direction) extend from each source driver IC 63*a*. Each pixel is composed of three cells of, for example, red (R), green (G) and blue (B) ones. Although illustration is omitted, the liquid crystal module 60 further includes required components such as a backlight for illuminating the liquid panel 61 and others. The liquid crystal module 60 uses an active matrix driving method herein.

In the TV 100, the tuner unit 20 receives a broadcast signal through the antenna 10. The tuner unit 20 converts the broadcast signal to an intermediate frequency signal, converts the intermediate frequency signal being an analog signal to a digital signal and extracts a transport stream (TS) from the digital signal. The tuner unit 20 outputs the TS to the signal processing unit 30. The signal processing unit 30 includes a descramble circuit, a demultiplexing circuit and a decoding circuit. The descramble circuit releases the scramble of the TS. The descrambled TS is composed of a plurality of transport packets each storing a video signal, an audio signal and various kinds of data. The demultiplexing circuit extracts from the TS a video signal (and an audio signal) related to a channel to be selected.

The video signal (and the audio signal) extracted from the TS has been encoded in accordance with the MPEG standard, so that the video signal (and the audio signal) is decoded by the decoding circuit in accordance with the MPEG standard. The signal processing unit 30 outputs the decoded video signal to the image processing unit 40. The image processing unit 40 is capable of subjecting the inputted video signal to various image processings such as the scaling process (resolution conversion process) corresponding to the number of pixels of the liquid crystal panel 61, a color correction process and an edge enhancement process if required and generates a frame image data representing an image of one screen. However, the scaling process is not required in the present embodiment. The frame image data is outputted to the timing controller (hereinafter referred to as "TC") 50.

The TC 50 divides the frame image data into a plurality of sub-frame image data and outputs each sub-frame image data to the above driver of the liquid crystal nodule 60 at a predetermined timing to cause the above driver to drive each pixel of the liquid crystal panel 61. As a result, an image corresponding to the aforementioned channel to be selected is displayed on the liquid crystal panel 61. The operation of the TC 50 is described later. The TC 50 realizes a dividing unit and a panel drive controlling unit.

Although illustration is omitted, the TV 100 further includes general configurations as a TV such as an audio signal circuit and a loudspeaker for outputting audio signals based on the decoded audio signals, a power supply circuit for supplying a driving power source to the each portion of the TV 100, and others.

2. First Embodiment

The first embodiment carried out by using the configuration of the TV 100 is described below.

In the present embodiment, a display based on the image data represented by a number of pixels is performed by a display panel the real pixels of which are fewer in number than the pixels of the image data. As an example, the TV 100 extracts a video signal conforming to the full HD standard from a broadcast signal to obtain a frame image data with pixels of 1920 (in the horizontal direction)×1080 (in the vertical direction). The number of real pixels of the liquid crystal panel 61 is taken as 960 (in the horizontal direction)×1080 (in the vertical direction). In other words, in the present embodiment, the number of real pixels of the liquid crystal panel 61 is half the number of pixels of the frame image data in the horizontal direction.

The TV 100 executes the following process based on the above premise.

Figure 2:
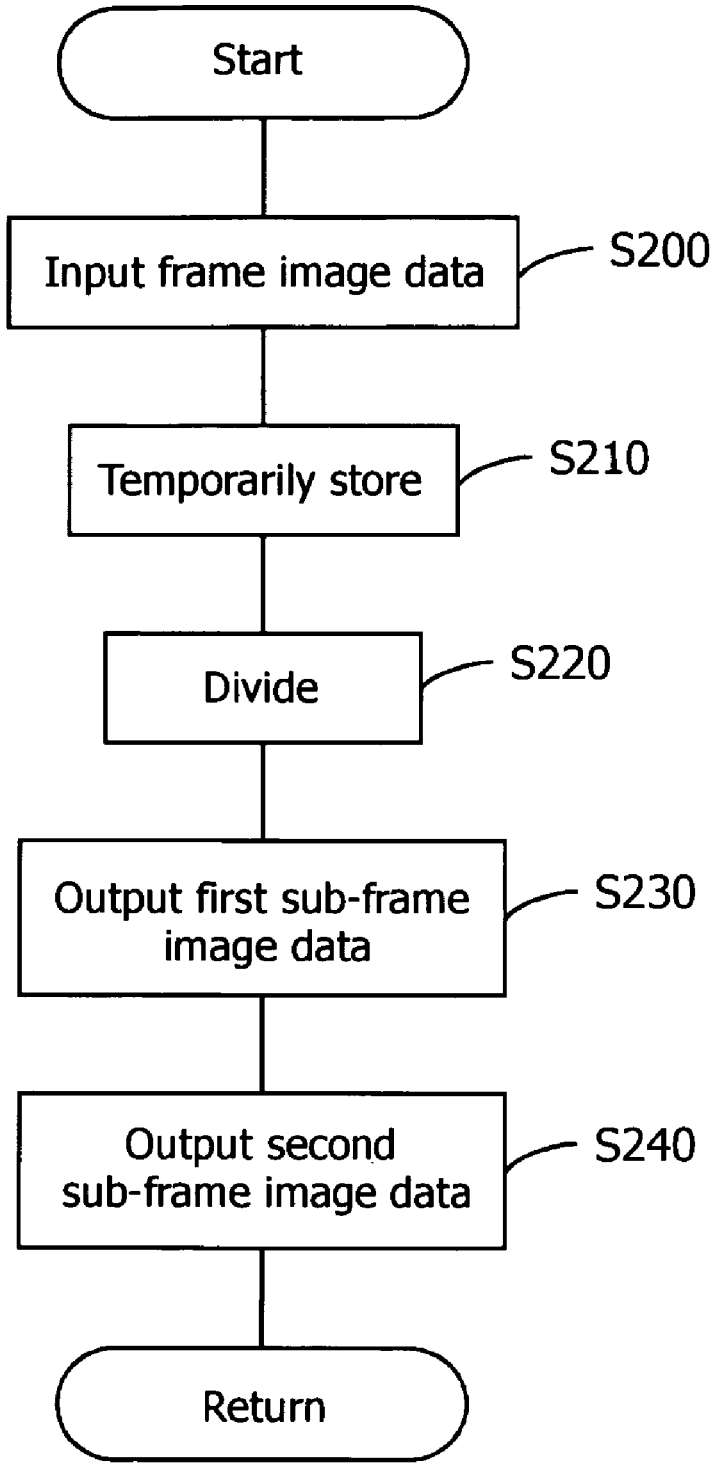
FIG. 2 is an example of flow chart illustrating process according to a first embodiment.

FIG. 2 is a flow chart illustrating the contents of a process related to a first embodiment and executed mainly by the TC 50.

At a step S200 (hereinafter, "step" is omitted and simply referred to as "S"), the TC 50 receives the frame image data from the image processing unit 40. The image processing unit 40 inputs the frame image data into the TC 50 according to a predetermined frame frequency (for example, 60 Hz).

At S210, the TC 50 temporarily stores the received frame image data in a predetermined buffer.

At S220, the TC 50 divides the frame image data into a plurality of sub-frame image data. In the present embodiment, the frame image data is divided into first sub-frame image data composed of pixel data in odd columns and second sub-frame image data composed of pixel data in even columns. Although each pixel of the frame image data has the gradations of RGB, hereinafter, the RGB values for each pixel are collectively referred to as the pixel data of the pixel.

Figure 3:
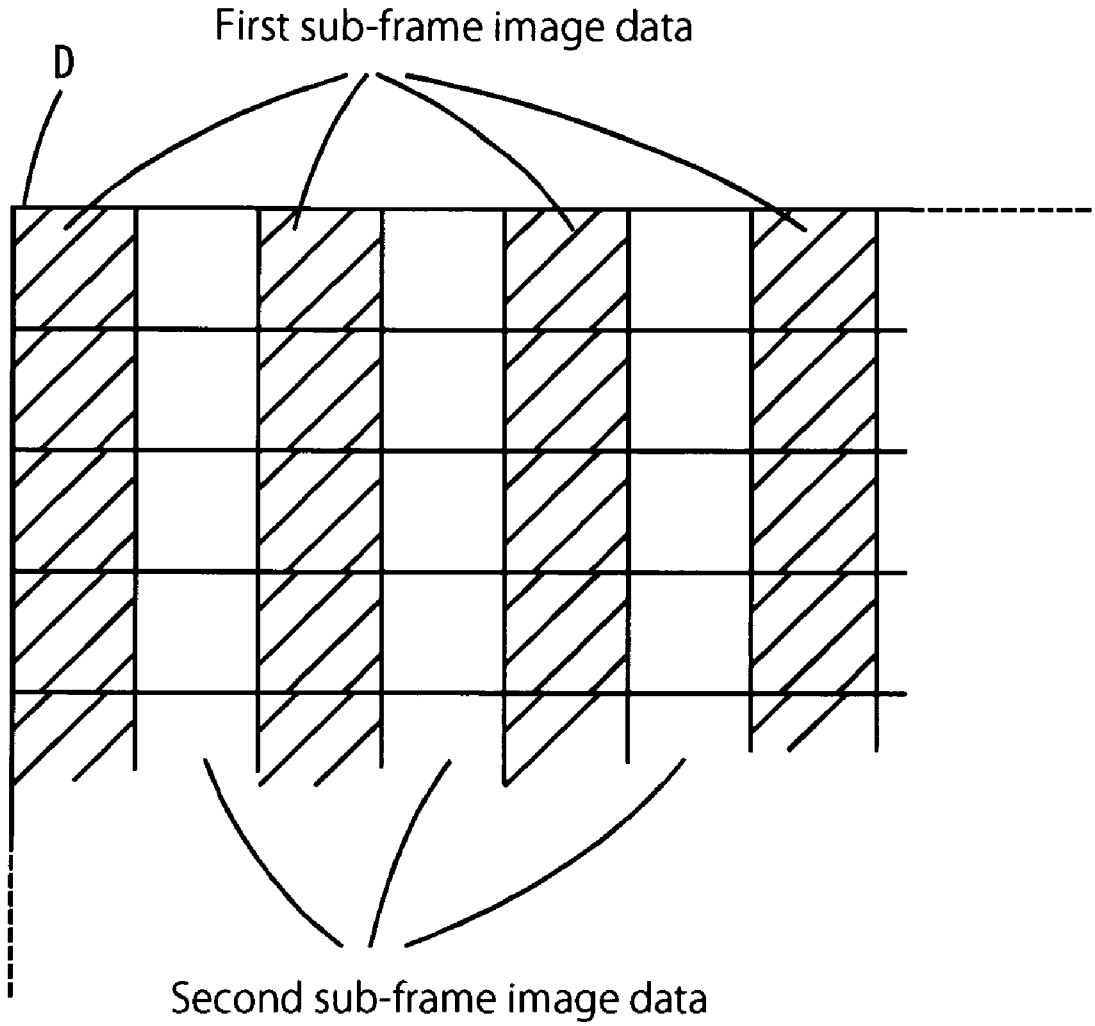
FIG. 3 is an example of schematic diagram illustrating part of frame image data.

FIG. 3 illustrates the pixels each corresponding to the first and the second sub-frame image data. The FIG. 3 illustrates part of the frame image data D. An aggregation of the pixel data of each hatched pixels (see hatching in FIG. 3) in the odd column is the first sub-frame image data. An aggregation of the pixel data of each pixels which is not hatched in the even column is the second sub-frame image data.

At S230, the TC 50 outputs the first sub-frame image data to the liquid crystal module 60. At this point, the TC 50 outputs each pixel data to the source driver 63 and controls the gate driver 62 so that each pixel data of the first sub-frame image data is corresponding one-to-one with each real pixel of the liquid crystal panel 61. In the present embodiment, as is apparent from the above description, the pixels of the first sub-frame image data is equal in number to the real pixels of the liquid crystal panel 61 both in the vertical direction and in the horizontal direction. The relationship between the pixel data D (2n−1) forming the first sub-frame image data and the data provided for the real pixels of the liquid crystal panel 61 is represented by the following equation:

$$Cr(n)=D(2n-1) \quad (1)$$

where, Cr (n) is the data provided for the n-th real pixel in the m-th row of the liquid crystal panel 61, and D (2n−1) is the pixel data of the (2n−1) th pixel in the m-th row of the frame image data, where n=1 to 960.

Figure 4:
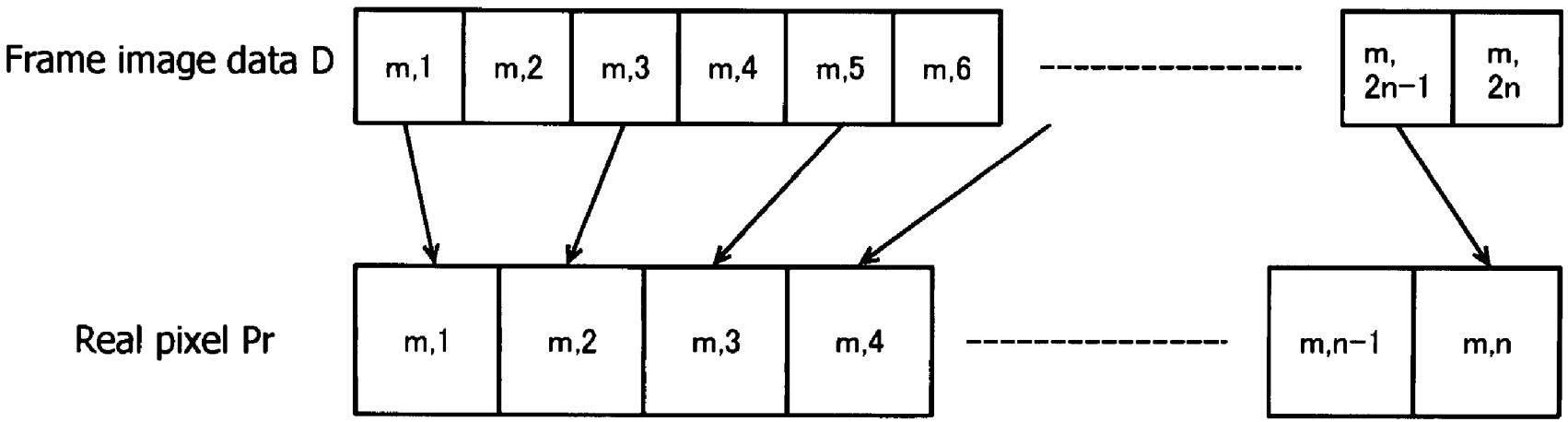
FIG. 4 is an example of diagram illustrating a corresponding relationship between first sub-frame image data and real pixels.

The above relationship is illustrated in FIG. 4. The pixel data of each odd numbered pixel in the m-th row of the frame image data D is outputted to and corresponding one-to-one with each real pixel Pr in the m-th row of the liquid crystal panel 61 in the order from the left. As a result, all the real pixels of the liquid crystal panel 61 are driven by the first sub-frame image data. The period (a first sub-frame period) when the liquid crystal panel 61 is driven by the first sub-frame image data is approximately 8.33 msec which is a half of one frame period. One frame period is 1/60 sec=about 16.66 msec.

Figure 5:
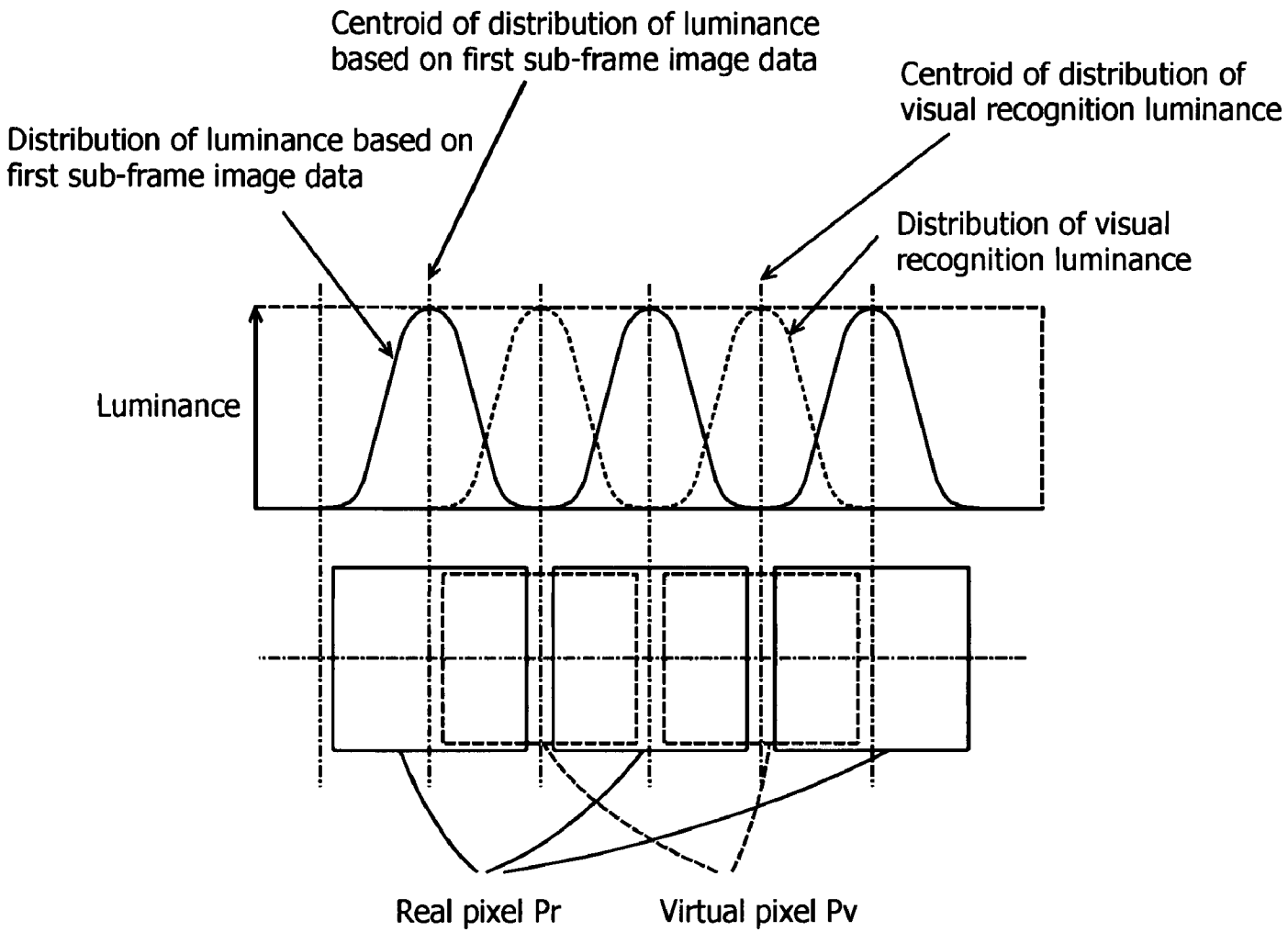
FIG. 5 is an example of diagram illustrating a positional relationship between real pixels and virtual pixels in the first embodiment.

FIG. 5 schematically illustrates the distribution of light emission luminance of each pixel of the liquid crystal panel 61. The lower part of the FIG. 5 illustrates three adjacent real pixels Pr in the m-th row indicated by solid lines. The upper part of the FIG. 5 illustrates the distribution of light emission luminance of each real pixel Pr in the first sub-frame period indicated by solid lines. Each real pixel Pr is emitted in one-to-one correspondence relation by each pixel data of the first sub-frame image data in the first sub-frame period, so that the position of the peak of light emission luminance distribution is corresponding one-to-one with each real pixel Pr and the centroid of each light-emission luminance distribution substantially coincides with the center of each real pixel Pr.

In the next place, at S240, the TC 50 outputs the second sub-frame image data to the liquid crystal module 60. At this point, the TC 50 outputs each pixel data to the source driver 63 and controls the gate driver 62 so that each pixel data of the second sub-frame image data is substantially equally distributed to two real pixels adjacent in the horizontal direction of the liquid crystal panel 61. The term "pixel data is distributed" means that each gradation of RGB of the pixel is divided by a certain ratio and each group of the divided gradations of RGB is distributed to each real pixel.

The relationship between the pixel data D (2n) forming the second sub-frame image data and data provided for a virtual pixel Pv of the liquid crystal panel is represented by the following equation:

$$Cv(n)=D(2n) \quad (2).$$

Where, Cv (n) is data provided for the n-th virtual pixel in the m-th row of the liquid crystal panel 61, and D (2n) is pixel data of the 2n-th pixel in the m-th row of the frame image data. The virtual pixel Pv is a virtual one on the liquid crystal panel 61 and presumed to be between real pixels adjacent in the horizontal direction. That is to say, in the present embodiment, the virtual pixel Pv is caused to emit light to substantially doubles the number of real pixels of the liquid crystal panel 61 apparently.

However, the virtual pixel Pv is merely a virtual existence and does not exist. Ones caused to emit light by the second sub-frame image data are the real pixels of the liquid crystal panel 61.

Then, the relationship between the pixel data forming the second sub-frame image data and data provided for the real pixel of the liquid crystal panel 61 is represented by the following equation:

$$Cr(n)'=k1\cdot D(2n-2)+k2\cdot D(2n) \quad (3).$$

Cr (n)' is data provided for the n-th real pixel in the m-th row of the liquid crystal panel 61. Needless to say, D (2n−2) is the pixel data of the (2n−2) th pixel (however, only of the first pixel or more exists) in the m-th row of the frame image data and part of the second sub-frame image data. k1 is a distribution ratio at which the pixel data D (2n−2) is distributed to the above n-th real pixel and k2 is a distribution ratio at which the pixel data D (2n) is distributed to the above n-th real pixel. In the present embodiment, k1 and k2 are fundamentally taken as 0.5.

Figure 6:
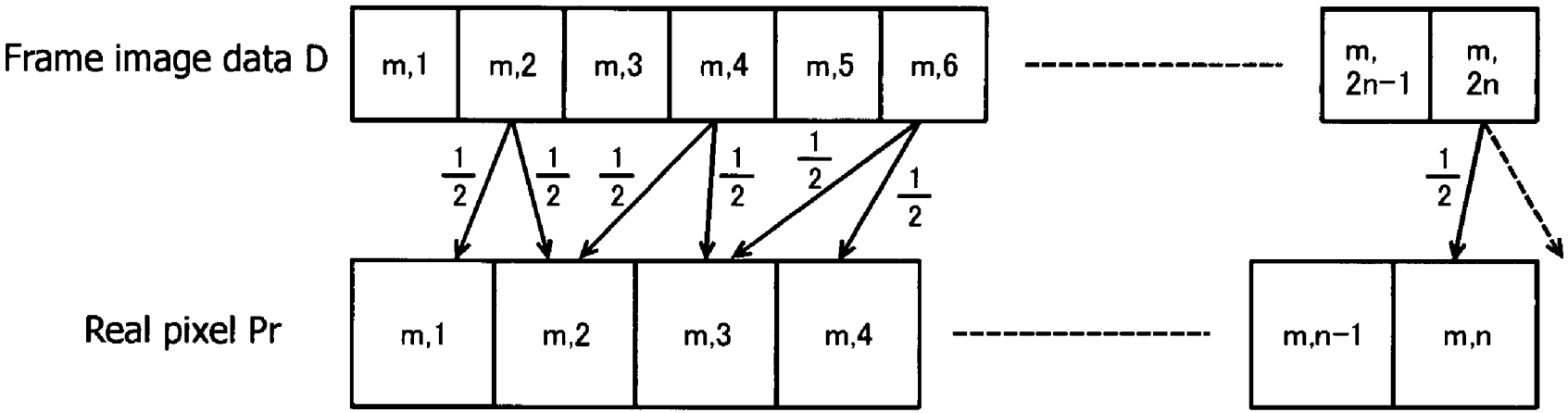
FIG. 6 is an example of diagram illustrating a corresponding relationship between second sub-frame image data and real pixels.

The above relationship is expressed by FIG. 6. The pixel data of the even-numbered pixels on the frame image data D are taken as data for virtual pixels, and data for virtual pixels (or pixel data of the even-numbered pixels on the frame image data D) are substantially equally distributed to two adjacent real pixels Pr existing at the virtual positions where virtual pixels exist on the liquid crystal panel 61. As a result, the liquid crystal panel 61 is driven by the second sub-frame image data to emit light. The period (a second sub-frame period) when the liquid crystal panel 61 is driven by the second sub-frame image data is also approximately 8.33 msec.

The flow chart in FIG. 2 shows a process for one frame image data, so that the TC 50 repeats the process every time the frame image data is inputted thereto.

The TC 50 realizes dividing unit and panel drive controlling unit in the light of executing the processes of the above S200 to S2400. In addition, the configuration including the TC 50 and the liquid crystal module 60 realizes the image display device.

Figure 7:
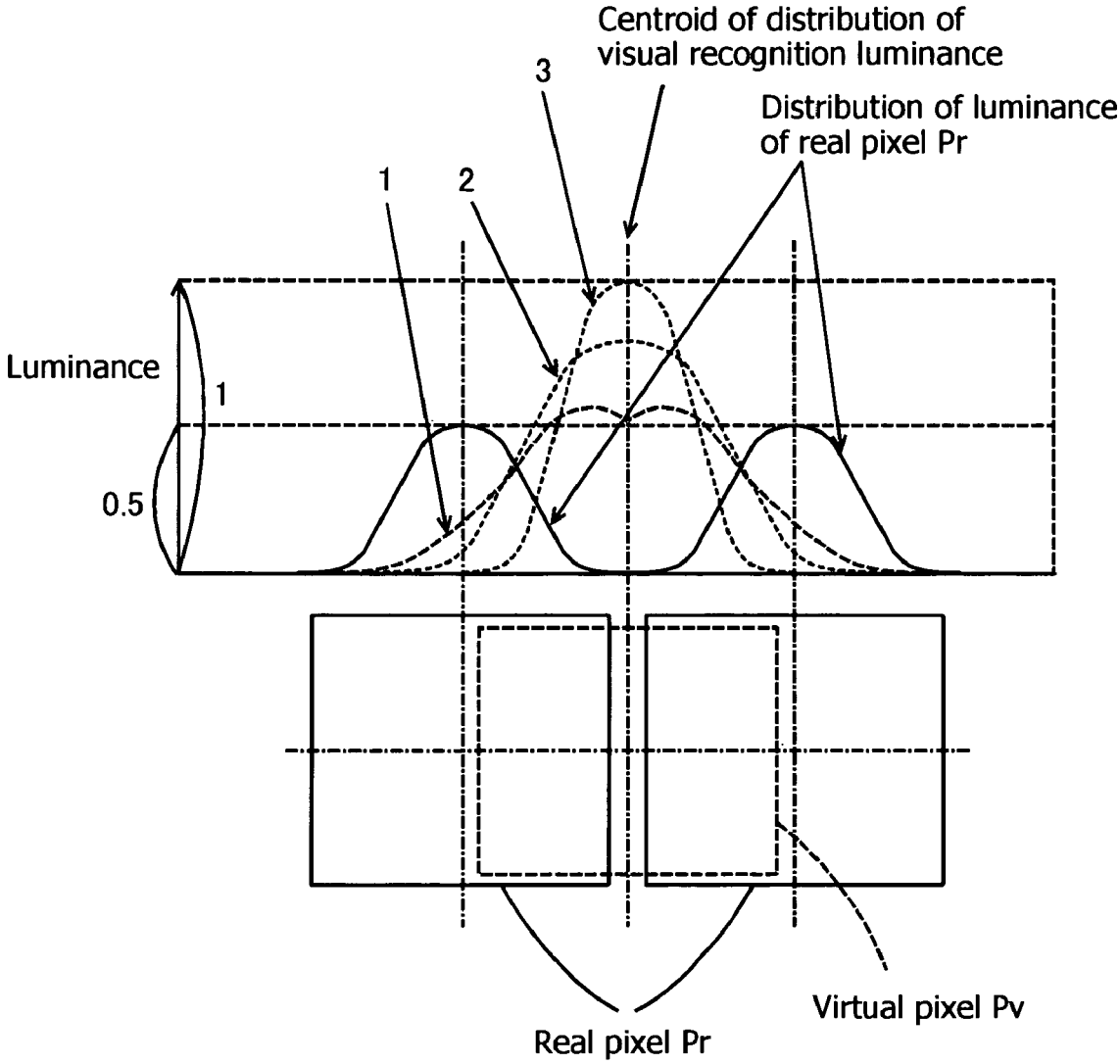
FIG. 7 is an example of distribution of visual recognition luminance based on the second sub-frame image data.

FIG. 7 schematically illustrates the distribution of light emission luminance on the liquid crystal panel 61 based on the second sub-frame image data. FIG. 7 illustrates the case where the pixel data of one pixel of the second sub-frame image data are distributed to two adjacent real pixels Pr. As is the case with FIG. 5, the lower part of FIG. 7 illustrates the real pixels Pr indicated by the solid lines. The upper part thereof illustrates the distribution of light emission luminance of each real pixel Pr indicated by the solid line. If luminance based on the pixel data before distributed is taken to be one (1), light emission luminance of each real pixel Pr (maximum luminance in the distribution of light emission luminance) after distributed with respect to the luminance of 1 is 0.5.

Furthermore, the upper part of FIG. 7 illustrates the luminance distribution (referred to as "distribution of visual recognition luminance") visually recognized by a user based on the second sub-frame image data indicated by chain lines 1 to 3.

When the user observes the liquid crystal panel 61 while gradually being away from the liquid crystal panel 61, it becomes difficult for the user to separately distinguish the luminance distribution of two real pixels Pr to which the pixel data for virtual pixels are substantially evenly distributed to emit light, and it also becomes impossible for the user to recognize the width of two real pixels Pr. At last, the user recognizes as if one pixel emitted light. At this point, the distribution of visual recognition luminance varies from chain lines 1 to 3 in FIG. 7 while an observation position is gradually away from the liquid crystal panel 61 and reaches an optimum position. That is to say, when the liquid crystal panel 61 is viewed from the optimum observation position, the distribution of visual recognition luminance based on two real pixels Pr to which the pixel data for virtual pixels are substantially evenly distributed to emit light is one which the light-emission luminance distribution of two real pixels Pr is synthesized and the centroid of distribution of visual recognition luminance lies in an approximately center position between two real pixels Pr. As a result, the user visually recognizes as if one pixel lay in the approximately center position between two real pixels Pr. The visually recognized pixel becomes a virtual pixel. The lower part of FIG. 7 illustrates a rough position of the virtual pixel Pv indicated by a chain line.

Description is continued with reference to FIG. 5 again. The upper part of FIG. 5 illustrates the distribution of light emission luminance based on the first sub-frame image data indicated by solid lines as described above, and such luminance distribution is visually recognized by the user. In addition, the upper part of FIG. 5 illustrates the distribution of visual recognition luminance based on the second sub-frame image data indicated by a chain line. As stated above, the centroid of distribution of visual recognition luminance lies in the approximately center position of each real pixel Pr. The TC 50 repeating the process in FIG. 2 causes the user to visually recognizes as if an image is displayed by the real pixel Pr and the virtual pixel Pv (indicated by the chine line) which is substantially equal in number to the real pixel Pr as illustrated in the lower part in FIG. 5. That is to say, according to the present embodiment, it is enabled to display the image data the number of pixels of which is 1920 pixels (horizontal)×1080 pixels (vertical) twice as many as that of the real pixels on the liquid crystal panel 61 with a number of real pixels of 960 (horizontal)×1080 pixels (vertical) without reducing the number of pixels of the image data.

The effects obtained by the present embodiment are described using an example in which a test image in which one vertical line moves in the horizontal direction is displayed on the liquid crystal panel 61.

Figure 8:
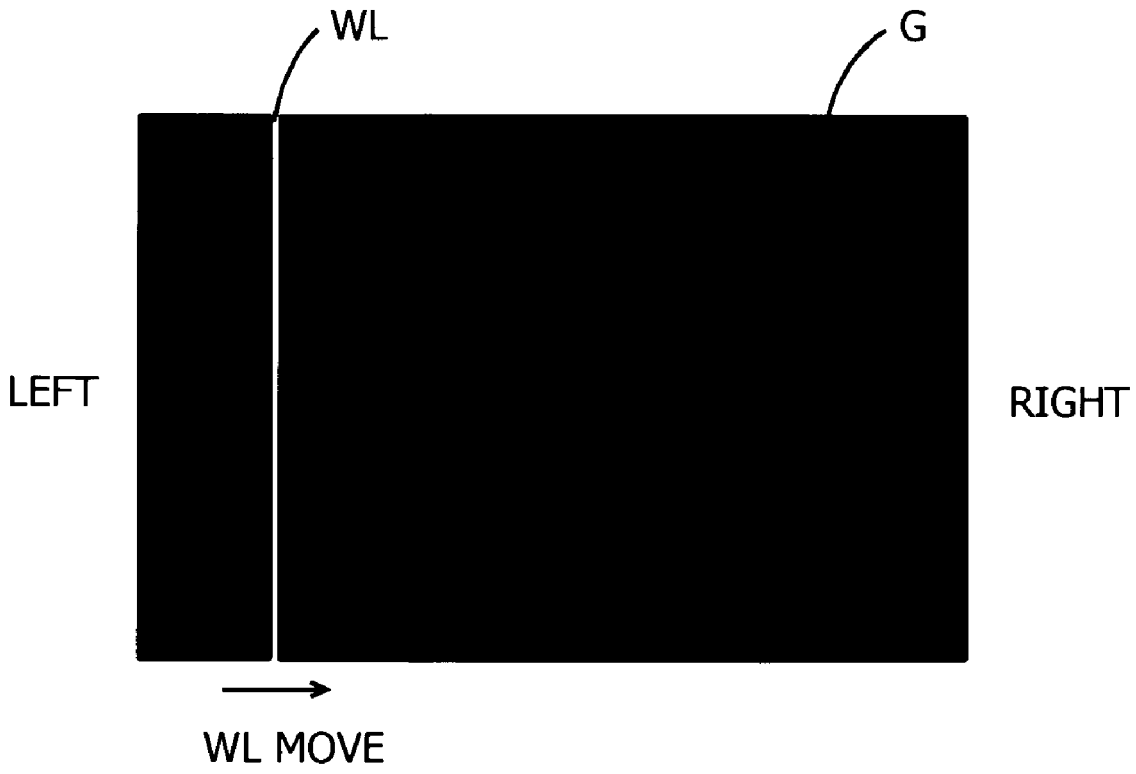
FIG. 8 is an example of a test image.

As illustrated in FIG. 8, as a concrete test image, for example, there exists an image G in which a white line WL moves from the left end to the right end of the screen against a black background. Suppose that each frame image data forming the test image G represents the white line WL by each pixel related to one pixel column and the black background by the other pixels unrelated to the one pixel column. If the white line WL is represented by the pixels in the odd column of the frame image data (or the first sub-frame image data), the white line WL is displayed by emission of only the real pixels forming one column of the liquid crystal panel 61 and, on the other hand, if the white line WL is represented by the pixels in the even column of the frame image data (or the second sub-frame image data), the white line WL is displayed by emission of the real pixels related to adjacent two columns of the liquid crystal panel 61. If the white line WL is displayed by emission of the pixels in the two columns, it is difficult for the user who watches the liquid crystal panel 61 from a remote distance to visually recognize the width of the two columns, therefore, the user recognizes as if the white line WL existed in an approximately center position between the two columns.

Accordingly, if the above test image G is displayed, the positions where the white line WL exists at each moment are approximately twice as many as the real pixels in the horizontal direction of the liquid crystal panel 61. In other words, the present embodiment enables realizing a very smoothly moving display on the liquid crystal panel 61 as is the case where the above test image G is displayed using a display panel the horizontal resolution of which is approximately twice as high as that of the liquid crystal panel 61. Needless to say, if an image is conventionally displayed with the number of pixels of the frame image data reduced to match with the number of pixels of the liquid crystal panel 61, it is not enabled to display the image with high picture quality using the liquid crystal panel 61 having a resolution exceeding the resolution of the liquid crystal panel 61 like the present embodiment.

3. Second Embodiment

The second embodiment using the configuration of the TV 100 is described below.

In the present embodiment also, a display based on image data represented by a number of pixels is performed by a display panel the real pixels of which are fewer in number than the pixels of the image data. As is the case with the first embodiment, the TV 100 extracts a video signal conforming to the full HD standard from the broadcast signal to obtain a frame image data formed of the pixels of 1920 (in the horizontal direction)×1080 (in the vertical direction). On the other hand, the number of real pixels of the liquid crystal panel 61 is taken as 640 (in the horizontal direction)×1080 (in the vertical direction). In other words, in the present embodiment, the number of real pixels of the liquid crystal panel 61 is one third the number of pixels of the frame image data in the horizontal direction.

The TV 100 executes the following process based on the above premise.

Figure 9:
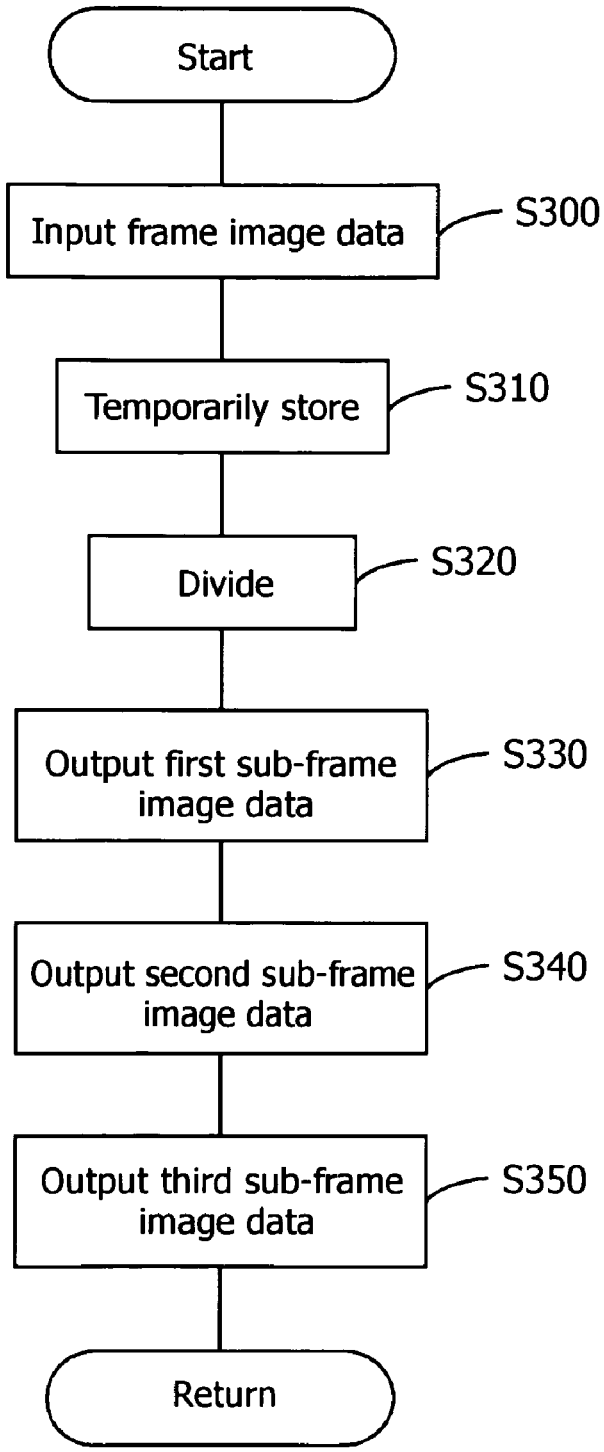
FIG. 9 is an example of flow chart illustrating a process according to a second embodiment.

FIG. 9 is a flow chart illustrating the process related to the second embodiment and the contents thereof executed mainly by the TC 50. The steps S300 and S310 are the same as the above steps S200 and S210, so that those are omitted to avoid repeated description thereof. The points different from the first embodiment are described below.

At S320, the TC 50 divides the frame image data into a plurality of the sub-frame image data. In the present embodiment, the frame image data is divided into a first sub-frame image data consisting of each pixel data in each left column in each region consisting of three adjacent columns, a second sub-frame image data consisting of each pixel data in each central column in each region mentioned above and a third sub-frame image data consisting of each pixel data in each right column in each region mentioned above.

Figure 10:
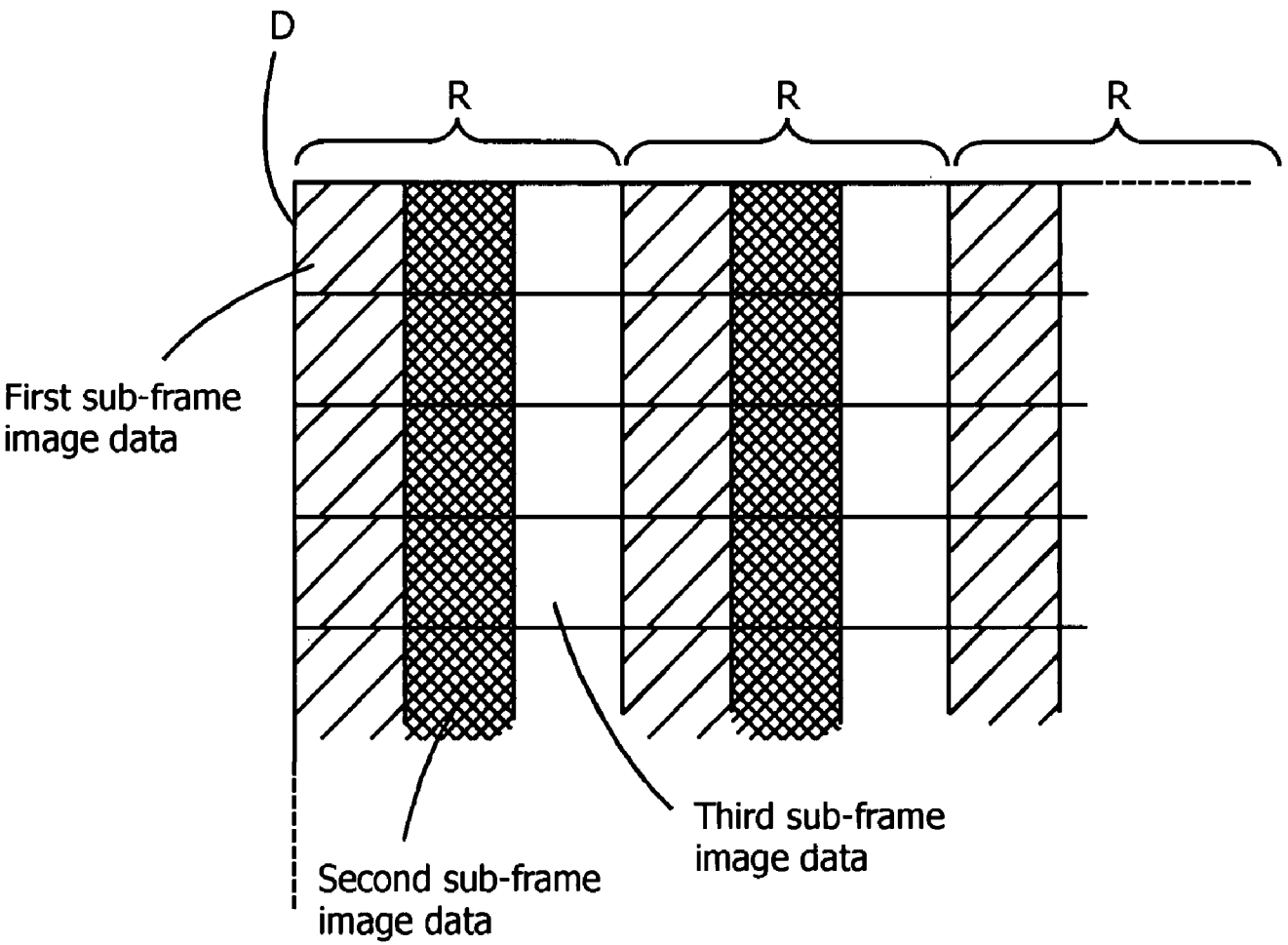
FIG. 10 is an example of schematic diagram illustrating part of frame image data.

FIG. 10 illustrates the pixels corresponding to the first, the second and the third sub-frame image data respectively. In FIG. 10, part of the frame image data D is illustrated. An aggregation of the pixel data of coarsely hatched pixels (see coarsely hatching in FIG. 10) in the left column (left-column pixel) in the region R is the first sub-frame image data. An aggregation of the pixel data of thickly hatched pixels (see thickly hatching in FIG. 10) in the central column (central-column pixel) in the region R is the second sub-frame image data. An aggregation of the pixel data of pixels represented by blank squares in the right column (right-column pixel) in the region R is the third sub-frame image data. The hatching shown in FIG. 3 and FIG. 10 doesn't show the color or density of each pixel.

At S330, the TC 50 outputs the first sub-frame image data to the liquid crystal module 60. At this point, the TC 50 outputs each pixel data to the source driver 63 and controls the gate driver 62 so that each pixel data of the first sub-frame image data is corresponding one-to-one with each real pixel of the liquid crystal panel 61. The number of pixels of the first sub-frame image data is equal to the number of real pixels of the liquid crystal panel 61 in the vertical and the horizontal direction. The relationship between the pixel data D (3n−2) of the left-column pixel forming the first sub-frame image data and data provided for the real pixels of the liquid crystal panel 61 is represented by the following equation:

$$Cr(n)=D(3n-2) \tag{4}$$

where, Cr (n) is data provided for the n-th real pixel in the m-th row of the liquid crystal panel 61, and D (3n−2) is the pixel data of the (3n−2) th pixel in the m-th row of the frame image data. In the present embodiment, n=1 to 640.

Figure 11:
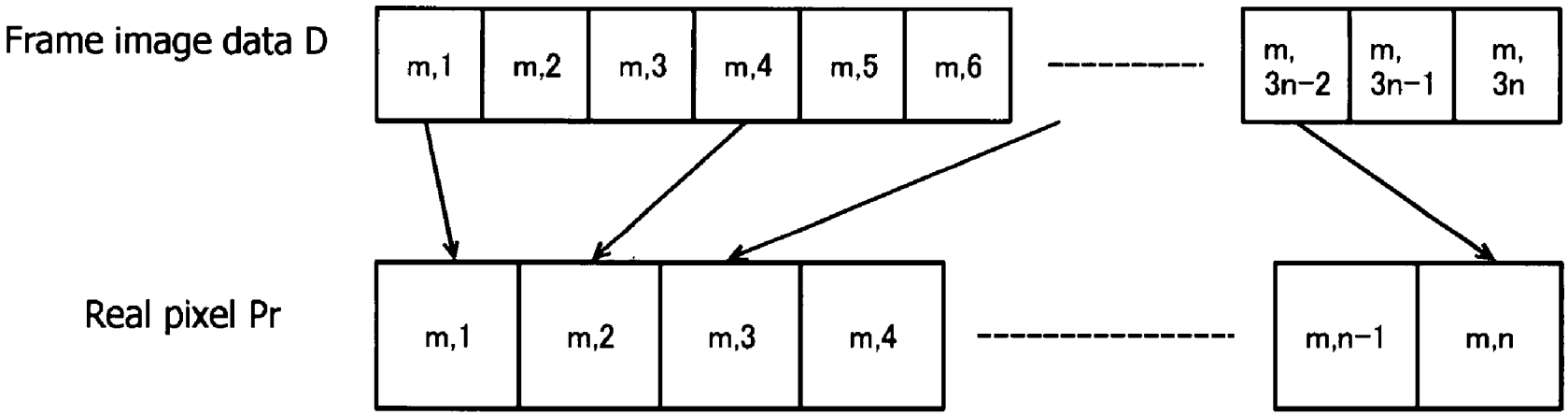
FIG. 11 is an example of diagram illustrating a corresponding relationship between the first sub-frame image data and real pixels.

This relationship is illustrated in FIG. 11. Each pixel data of pixels in the left column in the m-th row of the frame image data D is outputted to and corresponding one-to-one with each real pixel Pr in the m-th row of the liquid crystal panel 61 in the order from the left. As a result, all the real pixels of the liquid crystal panel 61 are driven by the first sub-frame image data. The first sub-frame period is approximately 5.55 msec which is one third of one frame period. One frame period is 1/60 sec=about 16.66 msec.

At S340, the TC 50 outputs the second sub-frame image data to the liquid crystal module 60. At this point, the TC 50 outputs each pixel data to the source driver 63 and controls the gate driver 62 so that each pixel data of the second sub-frame image data is distributed in a predetermined ratio to two real pixels adjacent in the horizontal direction of the liquid crystal panel 61. The relationship between the pixel data D (3n−1) of the central-column pixel forming the second sub-frame image data and data provided for the virtual pixels Pva of the liquid crystal panel 61 is represented by the following equation:

$$Cva(n)=D(3n-1) \tag{5}$$

Where, Cva (n) is data provided for the n-th virtual pixel Pva in the m-th row of the liquid crystal panel 61, and D (3n−1) is pixel data of the (3n−1) th pixel in the m-th row of the frame image data. The virtual pixel Pva is presumed to lie between the real pixels adjacent in the horizontal direction and in a position near the left real pixel with respect to the central position of both real pixels. However, as is the case with the first embodiment, ones caused to emit light by the second sub-frame image data are the real pixels of the liquid crystal panel 61.

The relationship between the pixel data forming the second sub-frame image data and data provided for the real pixel of the liquid crystal panel 61 is represented by the following equation:

$$Cr(n)'=k3\cdot D(3n-4)+k4\cdot D(3n-1) \tag{6}$$

Cr (n)' is data provided for the n-th real pixel in the m-th row of the liquid crystal panel 61. Needless to say, D (3n−4) is the pixel data of the (3n−4) th pixel in the m-th row of the frame image data and part of the second sub-frame image data. k3 is a distribution ratio at which the pixel data D (3n−4) is distributed to the above n-th real pixel and k4 is a distribution ratio at which the pixel data D (3n−1) is distributed to the above n-th real pixel. In the present embodiment, basically, k3 is taken as 1/3 and k4 as 2/3.

Figure 12:
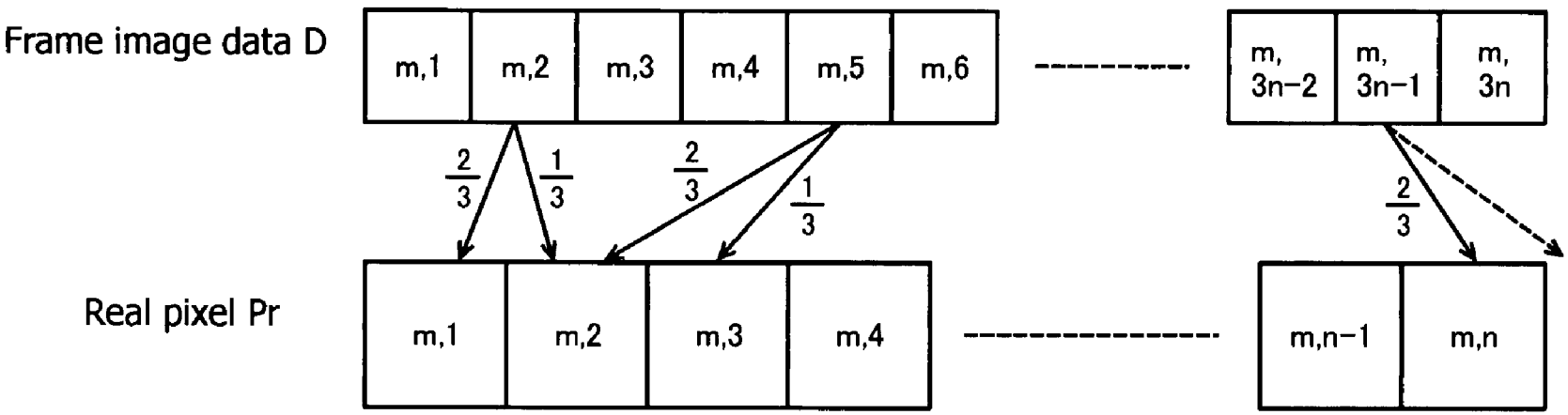
FIG. 12 is an example of diagram illustrating a corresponding relationship between the second sub-frame image data and real pixels.

The above relationship is illustrated by FIG. 12. Each pixel data of the central-column pixel in the m-th row of the frame image data D is taken as data for virtual pixel Pva, and, two thirds of the data for virtual pixel Pva are distributed to the left real pixel Pr out of two adjacent real pixels Pr existing at the virtual position where virtual pixels Pva exist on the liquid crystal panel 61 and one third of the data for virtual pixel Pva is distributed to the right real pixel Pr out of the two real pixels Pr. As a result, the liquid crystal panel 61 is driven by the second sub-frame image data to emit light. The second sub-frame period and the period when the liquid crystal panel 61 is driven by the third sub-frame image data described later (a third sub-frame period) are also approximately 5.55 msec.

At S350, the TC 50 outputs the each pixel data to the source driver 63 and controls the gate driver 62 so that each pixel data of the third sub-frame image data is distributed in a predetermined ratio to two real pixels adjacent in the horizontal direction of the liquid crystal panel 61. The relationship between the pixel data D (3n) of the right-column pixel forming the third sub-frame image data and data provided for the virtual pixels Pvb of the liquid crystal panel 61 is represented by the following equation:

$$Cvb(n)=D(3n) \quad (7).$$

Where, Cvb (n) is data provided for the n-th virtual pixel Pvb in the m-th row of the liquid crystal panel 61, and D (3n) is pixel data of the 3n-th pixel in the m-th row of the frame image data. The virtual pixel Pvb is presumed to lie between real pixels adjacent in the horizontal direction and in a position near the right real pixel with respect to the central position of both real pixels. However, ones caused to emit light by the third sub-frame image data are the real pixels of the liquid crystal panel 61.

The relationship between the pixel data forming the third sub-frame image data and data provided for the real pixel of the liquid crystal panel 61 is represented by the following equation:

$$Cr(n)''=k5\cdot D(3n-3)+k6\cdot D(3n) \quad (8),$$

Cr (n)" is data provided for the n-th real pixel in the m-th row of the liquid crystal panel 61. Needless to say, D (3n−3) is pixel data of the (3n−3) th pixel in the m-th row of the frame image data and part of the third sub-frame image data. k5 is a distribution ratio at which the pixel data D (3n−3) is distributed to the above n-th real pixel and k6 is a distribution ratio at which the pixel data D (3n) is distributed to the above n-th real pixel. In the present embodiment, basically, k5 is taken as ⅔ and k6 as ⅓.

Figure 13:
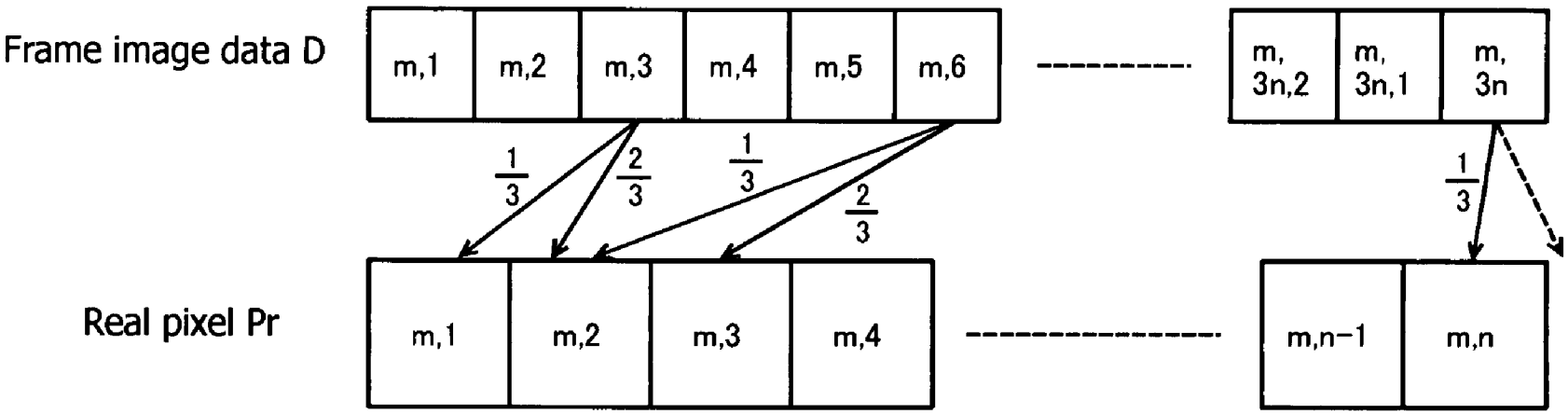
FIG. 13 is an example of diagram illustrating a corresponding relationship between third sub-frame image data and real pixels.

The above relationship is illustrated by FIG. 13. Each pixel data of the right-column pixel in the m-th row of the frame image data D is taken as data for virtual pixels Pvb, and one third of the data for virtual pixel Pvb is distributed to the left real pixel Pr out of two adjacent real pixels Pr existing at the virtual position where virtual pixels Pvb exist on the liquid crystal panel 61 and two thirds of the data for virtual pixel Pvb are distributed to the right real pixel Pr out of the two real pixels Pr. As a result, the liquid crystal panel 61 is driven by the third sub-frame image data to emit light.

Figure 14:
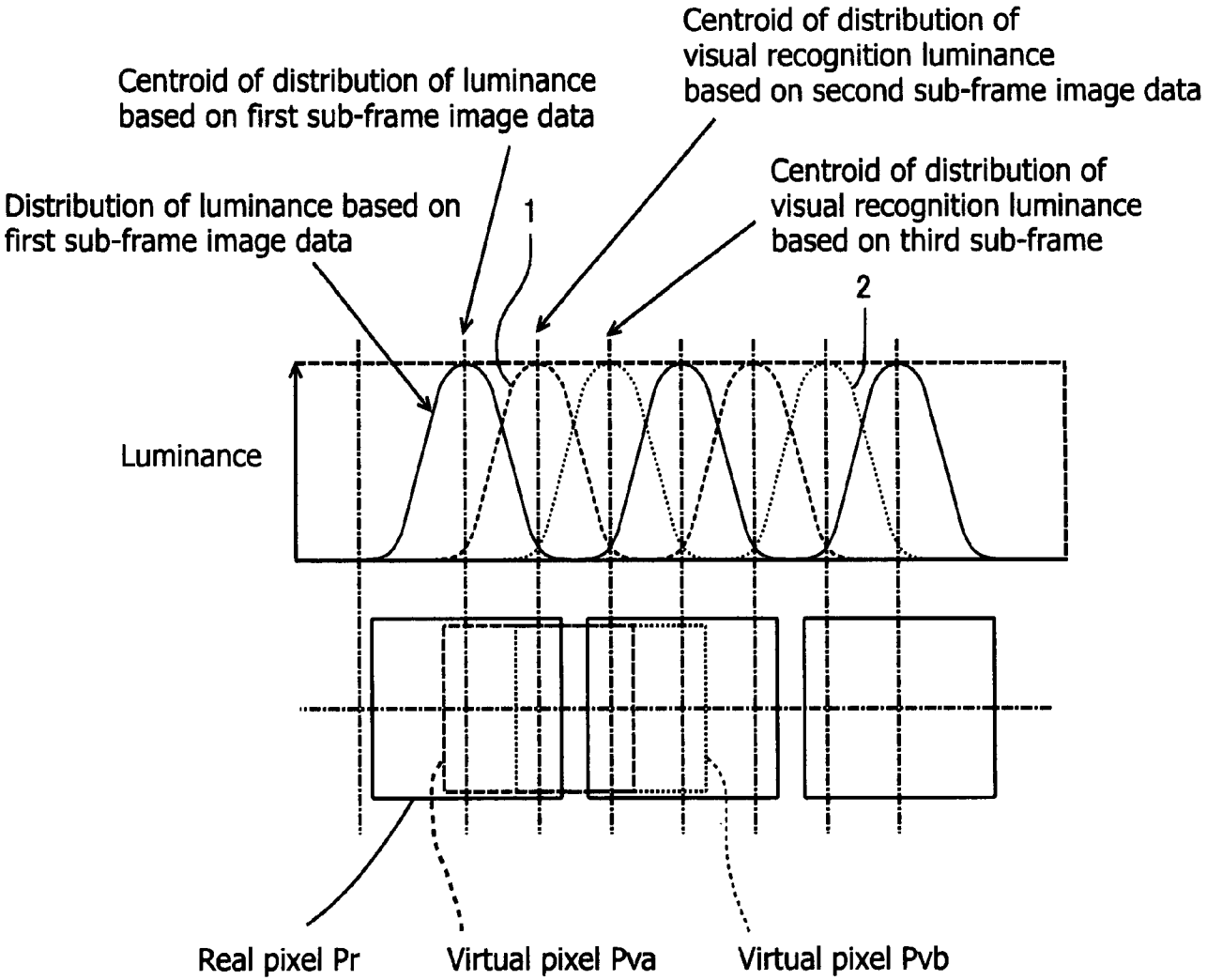
FIG. 14 is an example of diagram illustrating a positional relationship between real pixels and virtual pixels in the second embodiment.

FIG. 14 schematically illustrates the distribution of light emission luminance of each pixel of the liquid crystal panel 61. The upper part of FIG. 14 illustrates the distribution of light emission luminance of the real pixel Pr in the first sub-frame period indicated by solid lines. Each real pixel Pr is caused to emit light in one-to-one correspondence relation by each pixel data of the first sub-frame image data in the first sub-frame period, so that the position of the peak of distribution of light emission luminance is also corresponding one-to-one with each real pixel Pr and the centroid of each distribution of light emission luminance substantially coincides with the center of each real pixel Pr. The user visually recognizes such distribution of light emission luminance. In addition, the upper part of FIG. 14 illustrates the distribution of visual recognition luminance based on the second sub-frame image data indicated by a chain line 1 and the distribution of visual recognition luminance based on the third sub-frame image data by a chain line 2.

In the present embodiment, when the pixel data of one pixel of the second sub-frame image data is distributed to two adjacent real pixels Pr, the pixel data is distributed at a higher ratio to the left real pixels than to the right real pixels. That is to say, when the liquid crystal panel 61 is viewed from an optimum observation position, the distribution of visual recognition luminance based on the two real pixels Pr to which pixel data (pixel data of the central-column pixel) for the visual pixel Pva are distributed to emit light is one which the distribution of visual recognition luminance of two real pixels Pr are synthesized, and the centroid of distribution of visual recognition luminance lies in a position near the left side with respect to the central position of two real pixels Pr. As a result, the user visually recognizes as if one pixel exists in a position near the left side with respect to the central position of two real pixels Pr. This visually recognized pixel becomes a virtual pixel Pva.

Furthermore, in the present embodiment, when the pixel data of one pixel of the third sub-frame image data is distributed to two adjacent real pixels Pr, the pixel data is distributed at a higher ratio to the right real pixels than to the left real pixels. That is to say, when the liquid crystal panel 61 is viewed from an optimum observation position, the distribution of visual recognition luminance based on the two real pixels Pr to which pixel data (pixel data of the right-column pixel) for the visual pixel Pvb are distributed to emit light is one which the distribution of visual recognition luminance of two real pixels Pr are synthesized, and the centroid of distribution of visual recognition luminance lies in a position near the right side with respect to the central position of two real pixels Pr. As a result, the user visually recognizes as if one pixel exists in a position near the right side with respect to the central position of two real pixels Pr. This visually recognized pixel becomes a virtual pixel Pvb.

The TC 50 repeating the process in FIG. 9 causes the user to visually recognize as if an image is displayed by the real pixel Pr, the virtual pixel Pva which is substantially equal in number to the real pixel Pr and the virtual pixel Pvb which is substantially equal in number to the real pixel Pr as illustrated in the lower part in FIG. 14. That is to say, according to the present embodiment, it is enabled to display the image data the number of pixels of which is 1920 pixels (horizontal)× 1080 pixels (vertical) which are three times as many as the number of the real pixels on the liquid crystal panel 61 with a number of real pixels of 640 (horizontal)×1080 pixels (vertical) without reducing the number of pixels of the image data.

4. Conclusion

According to the present embodiment, frame image data representing the image of one screen is divided into a first and a second sub-frame image data according to a predetermined division rule that the frame image data is divided into an odd and an even column. An image is displayed such that each pixel data of the first sub-frame image data is brought into one-to-one correspondence with real pixels of the display panel and such that each pixel data of the second sub-frame image data or the like except the first sub-frame image data is distributed at a predetermined ratio to two adjacent real pixels on the display panel. For this reason, the user visually recognizes virtual pixels at a predetermined position between the real pixels on the display panel in addition to the real pixels thereon. Accordingly, a display panel the real pixels of which are fewer than the pixels of the frame image data enables displaying an image related to the frame image data without reducing the number of the pixels of the frame image data.

This eliminates the need for manufacturing and using a high-definition display panel matching image data in order to display the image data with a large number of pixels as in the Hivision broadcast, significantly reducing the manufacturing cost of the TV 100. Particularly, the number of components such as the source driver IC 63*a* and the gate driver IC 62*a* which increase as the number of pixels of the liquid crystal panel 61 increases can be reduced, which is very effective to reduce the manufacturing cost of the TV 100. As described above, the image data with a large number of pixels as in the HiVision broadcast can be displayed by the liquid crystal panel 61 even if the panel has a small number of real pixels, so that the displayed picture quality is maintained high as is the case where an image is displayed using a high-resolution display panel.

Although the first and the second embodiment take an example where the pixels in the horizontal direction of the display panel are fewer in number than the pixels in the horizontal direction of the image data, the present invention is also applicable to the case where the pixels in the vertical direction of the display panel are fewer in number than the pixels in vertical direction of the image data. In this case, for example, the odd rows of the frame image data are divided into the first sub-frame image data and the even rows of the frame image data are divided into the second sub-frame image data. Each image data of the second sub-frame image data or the like are distributed at a predetermined ratio to two real pixels adjacent in the vertical direction in the display panel. This doubles, triples or even quadruples an apparent resolution of the display panel in the vertical direction.

The number of the sub-frame image data provided by dividing the frame image data and the ratio at which each image data of the second sub-frame image data and others are distributed to real pixels are not limited to those stated above, various values may be used.

The technical concept of the present invention can be realized also by a concrete product of a liquid crystal television. That is to say, in a liquid crystal television includes a signal processing unit to demodulate a video signal from a received broadcast signal; an image processing unit to generate a frame image data representing an image of one screen in the video signal; a liquid crystal panel; a driver for driving each pixel of the liquid crystal panel based on a plurality of sub-frame image data; and a timing controller for generating a plurality of sub-frame image data from the frame image data and for outputting each sub-frame data to the driver to realize a display of the image on the liquid crystal panel;

the timing controller receives the frame image data and divides the frame image data into a first sub-frame image data composed of each pixel data in the odd column and a second sub-frame image data composed of each pixel data in the even column, the timing controller causes the driver to drive each pixel of the liquid crystal panel by outputting each pixel data of the first sub-frame image data to the driver with making each pixel data of the first sub-frame image data correspond to each pixel of the liquid crystal panel by one-to-one at a display period of the first sub-frame image data, and causes the driver to drive each pixel of the liquid crystal panel by outputting each pixel data of the second sub-frame image data to the driver with distributing each pixel data of the second sub-frame image data substantially equally to two pixels that are adjacent in the row direction in the liquid crystal panel at a display period of the second sub-frame image data.

Such a concrete configuration also achieves the same operation and effect as the above image display device. The above technical concept of the present invention is described by a category of articles of an image display device and a television. In addition to the above, it is needless to say that the present invention also comprehends an invention in an image process method including steps corresponding to each means and configuration provided by the above image display device and television and an invention in a program product causing a computer to execute processing functions corresponding to each means and configuration provided by the above image display device and television.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. An image display device that drives a display panel based a plurality of sub-frame image data produced from a frame image data representing an image of one screen to display the image, wherein the display panel comprises a matrix of N columns and M rows of pixels, and the frame image data comprises an array of N*K columns and M rows of pixel data, where K is an integer greater than 1, the image display device comprising:

a dividing unit configured to divide the frame image data into K number of sub-frame image data, wherein each of the K sub-frame image data is formed by an array of N columns and M rows of pixel data, such that $n^{th}$ column of pixel data of $k^{th}$ sub-frame image data corresponds to $(K*n-(K-k))^{th}$ column of pixel data of the frame image data and $m^{th}$ row of pixel data of the $k^{th}$ sub-frame image data corresponds to $m^{th}$ row of pixel data of the frame image data, for each n between 1 and N and each m between 1 and M and each k between 1 and K; and a panel drive controlling unit configured to consecutively drive the sub-frame image data into the display panel, such that the pixel data of the $n^{th}$ column and the $m^{th}$ row of a first sub-frame image data is applied to the pixel corresponding to the $n^{th}$ column and the $m^{th}$ row of the display panel, for each n of the N columns and for each m of the M rows, and the pixel data of the $n^{th}$ column and the $m^{th}$ row of remaining other sub-frame image data is distributed between a first pixel corresponding to the $n^{th}$ column and the $m^{th}$ row of the display panel and a second pixel corresponding to the $(n+1)^{th}$ column and the $m^{th}$ row of the display panel in a predetermined ratio, for each n of the N columns and for each m of the M rows.

2. The image display device according to claim 1, wherein the number of sub-frame image data K is 2, the dividing unit is configured to divide the frame image data into the first sub-frame image data wherein k equals 1 and a second sub-frame image data wherein k equals 2, and the panel drive controlling unit is configured to distribute each pixel data of the second sub-frame image data substantially equally between the respective first and second pixels of the display panel.

3. The image display device according to claim 1, wherein the dividing unit divides the frame image data into a first sub-frame image data composed of each pixel data in each left column in each region composed of three adjacent columns, a second sub-frame image data composed of each pixel data in each central column in each the region and a third sub-frame image data composed of each pixel data in each right column in each the region, and the panel drive controlling unit makes each pixel data of the first sub-frame image data correspond to each pixel of the display panel by one-to-one, and distributes each pixel data of the second sub-frame image data in a higher ratio to left pixel than to right pixel of two pixels that are adjacent in the row direction in the display panel, and distributes each pixel data of the third sub-frame image data in a higher ratio to the right pixel than to the left pixel of two pixels that are adjacent in the row direction in the display panel.

4. A liquid crystal television, comprising:

a signal processing unit to demodulate a video signal from a received broadcast signal;

an image processing unit to generate a frame image data representing an image of one screen in the video signal;

a liquid crystal panel;

a driver for driving each pixel of the liquid crystal panel based on a plurality of sub-frame image data; and a timing controller for generating a plurality of sub-frame image data from the frame image data and for outputting each sub-frame data to the driver to realize a display of the image on the liquid crystal panel;

wherein the liquid crystal panel comprises a matrix of N columns and M rows of pixels, and the frame image data comprises an array of 2*N columns and M rows of pixel data, the timing controller receives the frame image data and divides the frame image data into a first sub-frame image data and a second sub-frame image data, wherein the first sub-frame image data is formed by an array of N columns and M rows of pixel data, such that $n^{th}$ column of pixel data of the first sub-frame image data corresponds to $(2*n-1)^{th}$ column of pixel data of the frame image data and $m^{th}$ row of pixel data of the first sub-frame image data corresponds to $m^{th}$ row of pixel data of the frame image data and the second sub-frame image data is formed by an array of N columns and M rows of pixel data, such that $n^{th}$ column of pixel data of the second sub-frame image data corresponds to $2*n^{th}$ column of pixel data of the frame image data and $m^{th}$ row of pixel data of the second sub-frame image data corresponds to $m^{th}$ row of pixel data of the frame image data, for each n between 1 and N and each m between 1 and M; and the timing controller causes the driver to drive each pixel of the liquid crystal panel by outputting each pixel data of the first sub-frame image data to the driver such that the pixel data of the $n^{th}$ column and the $m^{th}$ row of the first sub-frame image data is applied to the pixel corresponding to the $n^{th}$ column and the $m^{th}$ row of the liquid crystal panel at a display period of the first sub-frame image data, for each n of the N columns and for each m of the M rows, and causes the driver to drive each pixel of the liquid crystal panel by outputting each pixel data of the second sub-frame image data to the driver such that the pixel data of the $n^{th}$ column and the $m^{th}$ row of the second sub-frame image data is distributed between a first pixel corresponding to the $n^{th}$ column and the $m^{th}$ row of the liquid crystal panel and a second pixel corresponding to the $(n+1)^{th}$ column and the $m^{th}$ row of the liquid crystal panel substantially equally at a display period of the second sub-frame image data, for each n of the N columns and for each m of the M rows.

5. An image display device that drives a display panel based a plurality of sub-frame image data produced from a frame image data representing an image of one screen to display the image, wherein the display panel comprises a matrix of N columns and M rows of pixels, and the frame image data comprises an array of N columns and M*K rows of pixel data, where K is an integer greater than 1, the image display device comprising:

a dividing unit configured to divide the frame image data into K number of sub-frame image data, wherein each of the K sub-frame image data is formed by an array of N columns and M rows of pixel data, such that $m^{th}$ row of pixel data of $k^{th}$ sub-frame image data corresponds to $(K*m-(K-k))^{th}$ row of pixel data of the frame image data and $n^{th}$ column of pixel data of the $k^{th}$ sub-frame image data corresponds to $n^{th}$ column of pixel data of the frame image data, for each m between 1 and M and each n between 1 and N and each k between 1 and K; and a panel drive controlling unit configured to consecutively drive the sub-frame image data into the display panel, such that the pixel data of the $n^{th}$ column and the $m^{th}$ row of a first sub-frame image data is applied to the pixel corresponding to the $n^{th}$ column and the $m^{th}$ row of the display panel, for each n of the N columns and for each m of the M rows, and the pixel data of the $n^{th}$ column and the $m^{th}$ row of remaining other sub-frame image data is distributed between a first pixel corresponding to the $n^{th}$ column and the $m^{th}$ row of the display panel and a second pixel corresponding to the $n^{th}$ column and the $(m+1)^{th}$ row of the display panel in a predetermined ratio, for each n of the N columns and for each m of the M rows.

* * * * *